US005772311A

United States Patent [19]

Williams et al.

[11] Patent Number: 5,772,311

[45] Date of Patent: Jun. 30, 1998

[54] OVERHEAD ANIMATED LIGHT DISPLAY

[75] Inventors: John S. Williams; Dennis R. Harrison; James Blake Gover, all of Las Vegas, Nev.

[73] Assignee: Young Electric Sign Company, Salt Lake City, Utah

[21] Appl. No.: 559,616

[22] Filed: Nov. 20, 1995

[51] Int. Cl.[6] ..... F21V 19/00

[52] U.S. Cl. ..... 362/238; 362/152; 362/225; 362/249

[58] Field of Search ..... 362/147, 238, 362/240, 249, 250, 252, 145, 152, 225

[56] References Cited

U.S. PATENT DOCUMENTS

| | | | |
|---|---|---|---|
| Re. 34,135 | 12/1992 | Madsen et al. | 315/250 |
| 3,831,020 | 8/1974 | Paulson | 362/293 |
| 3,890,170 | 6/1975 | Russ | 148/175 |
| 4,420,798 | 12/1983 | Herst et al. | 362/147 |
| 4,639,879 | 1/1987 | Chaya | 364/518 |
| 4,761,641 | 8/1988 | Schreiber | 340/717 |
| 4,771,278 | 9/1988 | Pooley | 340/780 |
| 4,820,956 | 4/1989 | Slobodzian et al. | 315/51 |
| 5,028,939 | 7/1991 | Hornbeck et al. | 346/160 |
| 5,113,329 | 5/1992 | Lin | 362/238 |
| 5,130,914 | 7/1992 | Bengochea | 362/364 |
| 5,184,114 | 2/1993 | Brown | 340/701 |
| 5,319,182 | 6/1994 | Havens et al. | 346/160 |

*Primary Examiner*—Stephen F. Husar
*Attorney, Agent, or Firm*—Trask, Britt & Rossa

[57] ABSTRACT

An overhead arcade-like light display is disclosed. The display comprises a canopy of an open framework with elongated linear raceways containing electrical wiring and supporting thousands of bulbs gathered in groups of four identified herein as pixels. Pixels are closely and regularly spaced. The raceways are linearly positioned running the length of said arcade and placed parallel to one another to position themselves to become the interior arcuate frame structure. Each pixel is covered with a light diffusing dome and the individual bulbs are of a different color so that colors, shades, tones and hues of a thousand varieties may be obtained from each domed pixel. A display having in excess of one million bulbs with minimal wind resistance is readily constructible.

9 Claims, 9 Drawing Sheets

OVERHEAD ANIMATED LIGHT DISPLAY

BACKGROUND OF THE INVENTION

1. Field of the Invention

The instant invention relates to computer controlled, large-scale electrical light displays providing information or entertainment.

2. State of the Art

Electrical light displays of various types exist for providing information or entertainment. Generally these displays have a planar face and use groups of bulbs or a TV screen or similar display surface.

Displays which use large arrays of bulbs usually have bulbs grouped to form a unit called a pixel where those groups are similar to other groups and the lamps or bulbs in each pixel are individually controlled in some manner. Having a planar surface permits all the wiring and mounting of the bulbs to take place behind a generally large, flat surface of some type which hides and protects electrical devices and connections from the weather.

Examples of various types of illuminated displays and associated electronics are described in the following U.S. Pat. Nos. Madsen et al. Des. 34,135; Brown 5,184,114; Slobodzian 4,820,956; and Pooley 4,771,278. These patents generally describe various types of illuminated displays using matrices of light sources. In some displays, LED's are used while in others incandescent lamps are used. While LED and bulb or lamp displays may both display information, LED displays generally are not suitable for large, remote displays, although requiring much less power overall, and employ simplifying switching and the like in comparison to incandescent displays.

In Pooley, a planar display system structured to give an effect similar to a video screen uses an array of incandescent lamps, which can be individually controlled to various levels of intensity. A simulated video-type image in black and white can be accomplished through use of a large number of lights. Displays having up to about 19,000 lamps are mentioned.

Slobodzian describes displays of lamps in X-Y matrices with pixels formed of groups of lamps, e.g., a red, green and blue lamp representing a pixel. Individual control of each lamp in a pixel can provide a red, green or blue color.

SUMMARY OF THE INVENTION

A very large outdoor electrical lamp display having an elongated, open-framed structure with unique linear raceway members positioned closely adjacent to one another has been invented. The raceways run the length of the support structure. The raceways have a box-like cross-section and are structured and adapted to house internally electrical wiring. The raceways have closely spaced groups of openings into which electrical lamps are placed.

A free-standing electrical lamp information or entertainment display has been invented. In one embodiment an arcade structure comprises an elongated arcuate open frame structure supported overhead by spaced stanchions. The lateral aspect of the arcade structure is preferably an arch formed by an arc of a circle which may be up to about 180°. The peak of the arch is generally positioned at least thirty feet or more off the ground. Unique linear raceways run the length of the arcade and are positioned parallel to one another over a significant portion of the interior framework of the arch. Groups of electrical lamps, such as lamp quartets, identified herein as pixels, are regularly and closely spaced on said raceways to form the lighting units which provide information and/or animation of an entertainment variety. The raceways are laterally spaced from one another with the lamps generally facing to the interior of the structure.

The raceways contain electrical components and wiring which are connected to one or more computers which control the electrical lamps to give desired lighting displays. The free-standing support structure may be positioned over a street, sidewalk, plaza or other pedestrian area such that people walking below are able to look up and see a large electrical overhead display providing entertainment or information. The open framework of the structure, e.g, an arcade-like structure, provides minimal wind resistance and while the raceways are spaced closely together they generally are not in a touching relationship so as to provide minimal sail area, that is, area which provides wind resistance.

In one embodiment, an arcade may be constructed to be hundreds of feet or even a thousand feet or more in length and a width of thirty or more feet with widths upwards of seventy feet being typical with widths up to 200 feet giving a particularly impressive mass to the electrical display. An arcade having a length of over a thousand feet and a width of upwards of seventy feet may have a total of over two million bulbs and in excess of 500,000 pixels.

Each bulb and each pixel is separately controlled from all other bulbs and all other pixels. Each pixel is generally formed by four bulbs in very close relationship, usually on centers of less than one and a half inches between bulbs. The pixels are spaced generally less than ten inches on center and preferably at about eight inches on center. Pixels having only three colored bulbs could be used although four bulbs are preferred. Each pixel is covered by a diffusion dome which is preferably a translucent plastic cover which blends the light emanating from the lamps in a particular pixel. Upwards of 65,000 colors, shades, hues, tints and tones are available from each pixel using the diffusion cover and computer control of each lamp in a pixel. The lamps in a given pixel are preferably green, blue, red and white and are preferably controlled individually with the intensity of each light ordinarily controllable from zero, that is, an unlit state to a maximum lumen intensity. Typical lamps may be from about 2 to about 10 watts, preferably about 4 to 6 with a typical pixel having a total wattage of from about 12 to about 40 watts.

DETAILED DESCRIPTION OF THE INVENTION

The invention involves unique free-standing electrical light displays having an open-framed structure in which spaced group of lighting elements identified herein as "pixels" are positioned on unique raceways and especially including pre-assembled panels of such raceways. The raceways may individually be joined end-to-end to form extended linear raceways to house wires, electrical components, including switching, dimming and similar components as well as providing support for a large plurality of uniformly spaced pixels, which are generally a close grouping of a plurality of multi-colored bulbs.

The structure of the raceways and their spaced grouping as panels permit very large-scale, free-standing open-framed structures to be constructed.

The instant invention involves in one embodiment, a three-dimensional, free-standing, elevated, lighting, display structure of very large dimensions. An arcade structure forming a large canopy which is elevated a significant height over a pedestrian walkway area is formed of open beam members constructed to form an extended arch. The open-framed arch extends linearly for a considerable length. The interior or downward facing portion of the arch is constructed so that lamp-containing raceways may be attached in groups to form a large electrically illuminated visual display for either informational or entertainment purposes. Groups of unique raceways are preferably pre-assembled to form lattice structures which may be readily attached to the arcade open-framed structural members. The open framework nature of the support structure reduces wind resistance in comparison to solid or large unitary panel-type structures. The unique raceways of this invention provide a low wind-resistant, weather-resistant housing for the electrical leads, components etc. associated with a large light display.

Figure 1:
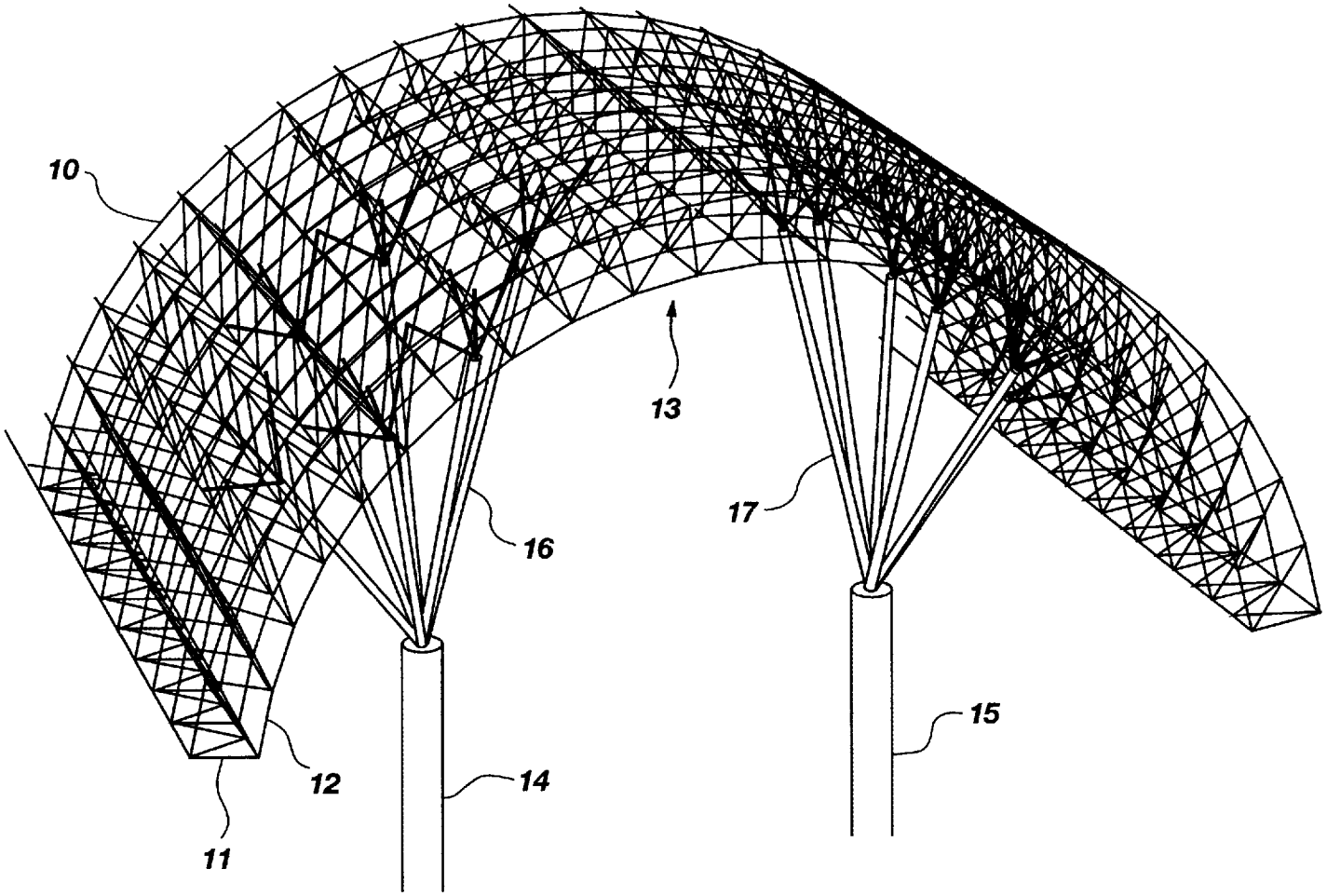
FIG. 1 is a perspective view of a portion of the structural framework of the arcade.

Further understanding the invention may be facilitated by reference to the attached drawings wherein FIG. 1 is a perspective view of a portion of an arcade-like structure supported by a pair of stanchions. The arcade-like structure 10 is formed from struts 11 and stringers 12 connected together to form a truss-like arch 13 which, geometrically, is preferably an arc or portion of a circle. The arch extends lengthwise so that the open framework canopy-like structure forms preferably a portion of a cylinder, i.e., an open-framed, arcade-like structure.

In FIG. 1 a pair of stanchions 14 and 15 are shown in vertical orientation with a group of arms extending form the top of the stanchion so that the arms 16, 17 and similar arms fan out to be connected to different portions of the open frame-like structure to support it in an elevated position. In the illustration of FIG. 1, six arms such as arm 17 extend at various angles from the top of stanchion 15 to connect to the open framework structure. The arm members 17 attach either directly or indirectly at various points the arc-like structure, both along the curved portion of the structure and along the length of the structure.

Figure 2:
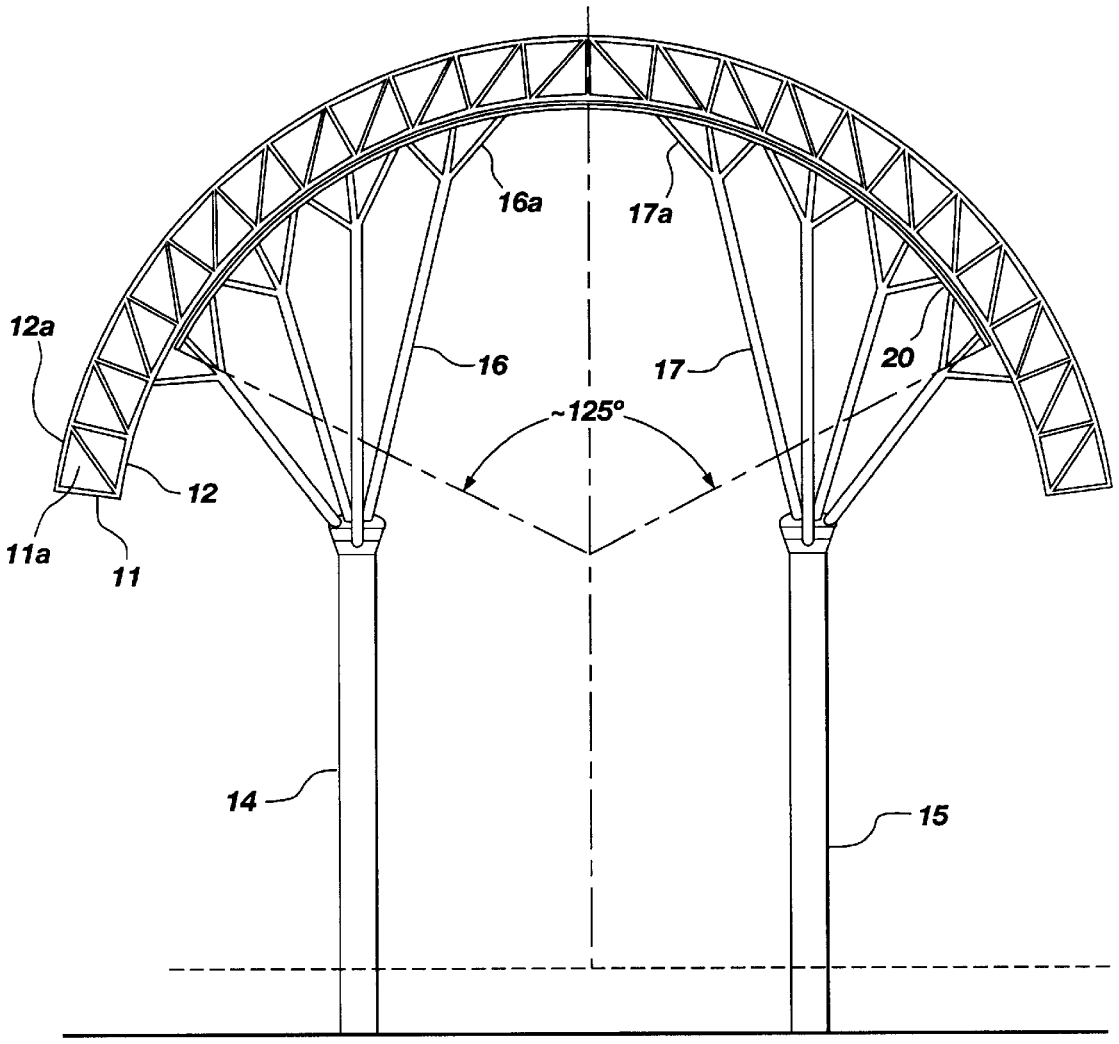
FIG. 2 is an elevational head-on view of the arcade structure.

A further view of the arcade-like structure is illustrated in FIG. 2 which is an elevational front view of the structure. Arm 16 projecting from stanchion 14 is subdivided into subarms or rods 16A, 16B and so forth. Three rods are attached to the top of arm 16 for attachment to different portions of the open frame arcade-like structure. The open frame-like structure is formed of interior struts or interior stringers 12A and 12 and exterior stringer 12A. The exterior stringer is slightly longer than the interior stringer so that the arch or curvature of the arcade is formed. Struts 11 substantially radiate from a focal point of the curved arch of the arcade-like structure while struts 11A are placed diagonally within the box-like structure formed by the structures along the curvature of the arch and the struts radiating from the focal point of the arch. Thus, the arch is not a pure continuous curve but approximates a pure curve because of the shortness of the stringers 12 so that the curvature of the arch is formed by a large plurality of short, straight sections. The height of the structure may be upwards of fifty feet or more from ground level to the peak of the interior portion of the arch. The arch may comprise an arc of up to about 180°. In the instant illustration the arc is approximately 160°. The lateral or horizontal spacing between stanchions 14 and 15 may be anywhere from twenty to forty feet.

The radius of the arch of the arcade may be from about twenty to about fifty feet. The height and other dimensions of the arcade-like structure are sufficiently large that a viewer standing at street level does not readily perceive individual points of light but perceives the points of light as being sufficiently merged to form a substantially continuous illuminated surface. Also the structure is sufficiently large so that large numbers of persons, e.g., thousands, may be under the arcade to see the light displays.

The size of the arcade structure represents a challenge as to the placement of lighting units or pixels as they are identified herein. A pixel for the purposes of this invention is a group, preferably a quartet, of closely spaced lamp bulbs (see FIG. 7D) which is covered by a translucent diffusion cover (see FIG. 6A and 6B). The light bulbs are preferably colored red, green, blue and white and each bulb is individually controlled as to the amount of voltage applied to it so that a very large spectrum of colors, hues, shades and tones, including black and white at various intensities may be displayed by each pixel. The distance of each pixel from the eye of the viewer and the close proximity of one pixel to the next is such that the viewer sees what appears to be a substantially continuous illuminated surface even though in the instant invention the pixels are spaced both laterally and longitudinally from one another.

Figure 3:
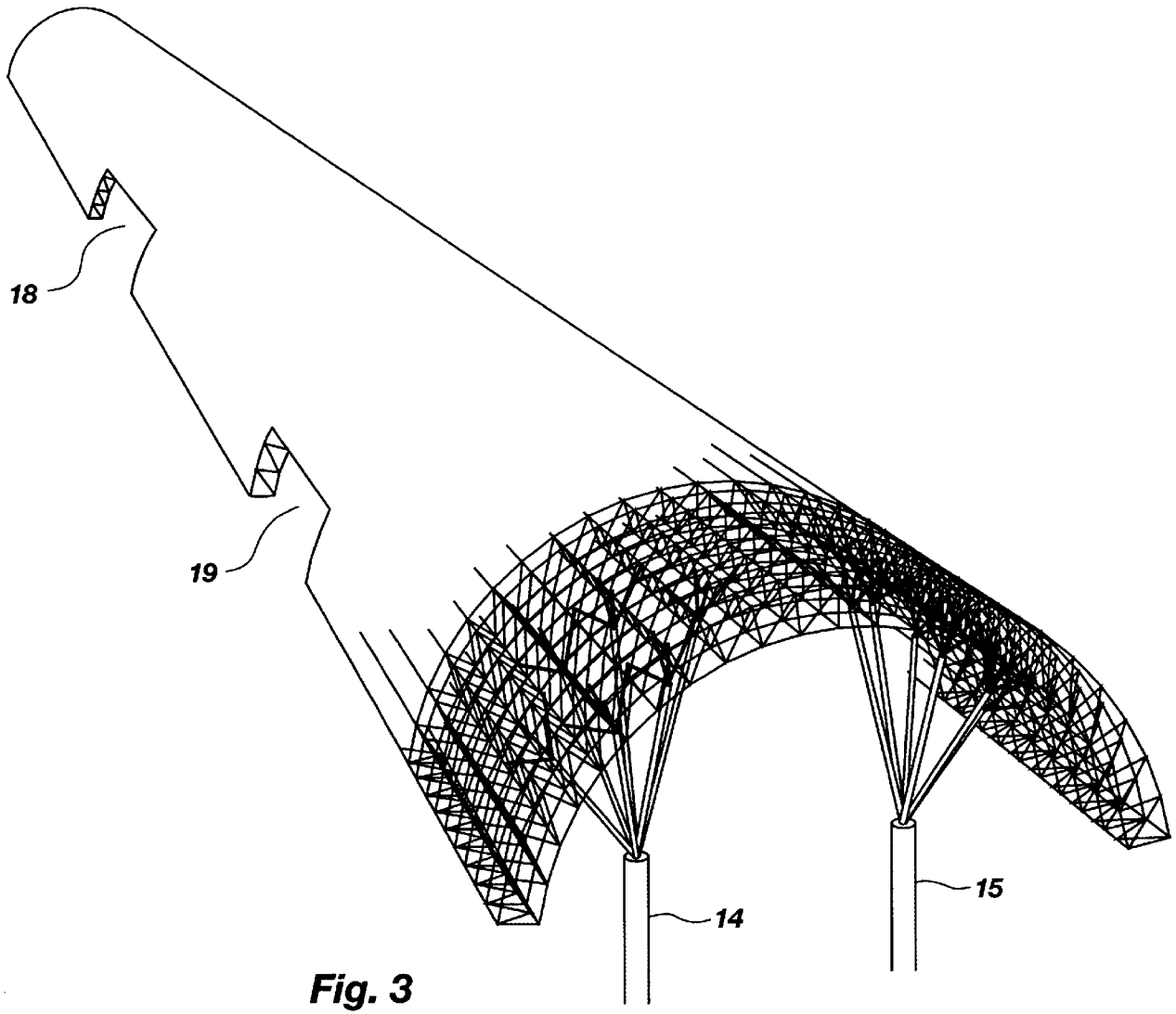
FIG. 3 is a perspective view of the full length of the arcade structure.

The illustration in FIG. 3 shows the relationship of the length of the arcade to its arch height and width. In the illustration of FIG. 3 there are indented portions, i.e., openings, 18 and 19 and similar openings (not shown) directly transversely across the arcade from the illustrated openings to permit cross traffic of high rise trucks and vehicles inasmuch as the arcade may extend a long distance along a particular street or pedestrian byway wherein cross traffic exists. The indentations or passageways 18 and 19 are preferably such that they do not extend into the visual display area of the arcade-like structure. As may be seen from FIG. 2, display members 20 extend along the interior surface of the arch across an angle of about 125° of the arch to present the visual display surface. The included angle may vary from less than about 90° to about 180°. This visual display surface is preferably not interrupted by passageway openings such as openings 18 and 19. The "curved" arch members are supported above the ground by tall, sturdy, upright support members, e.g., beams.

Heretofore, most large illuminated displays were positioned on a continuous, solid panel or facade which contained bulbs on its face and had an enclosed rear structure which contained all the wiring, electrical connections, electrical controls and the bulb fittings and the like. In an arcade-like structure or other open-framed structure, the use of solid panels would present a large wind surface and would block the sun during the daytime. For example, an arcade-like structure with solid panels would form a roof, completely blocking the sun and making the underneath area dark and uninviting. Also, solid panels would make access to electrical components, electrical controllers and bulb fittings and the like behind a large, continuous panel would be very difficult. To address these problems the lamp bulbs are supported on the face of narrow raceways which enclose the electrical wiring, connectors, switching devices, bulb sockets, and the like. These individual raceways are preferably collected and constructed as a pre-assembled, lattice structure as illustrated in FIGS. 4 and 5 whereby individual, lattice structures are put in place on the arcade and joined together there both electrically and structurally.

Figure 4:
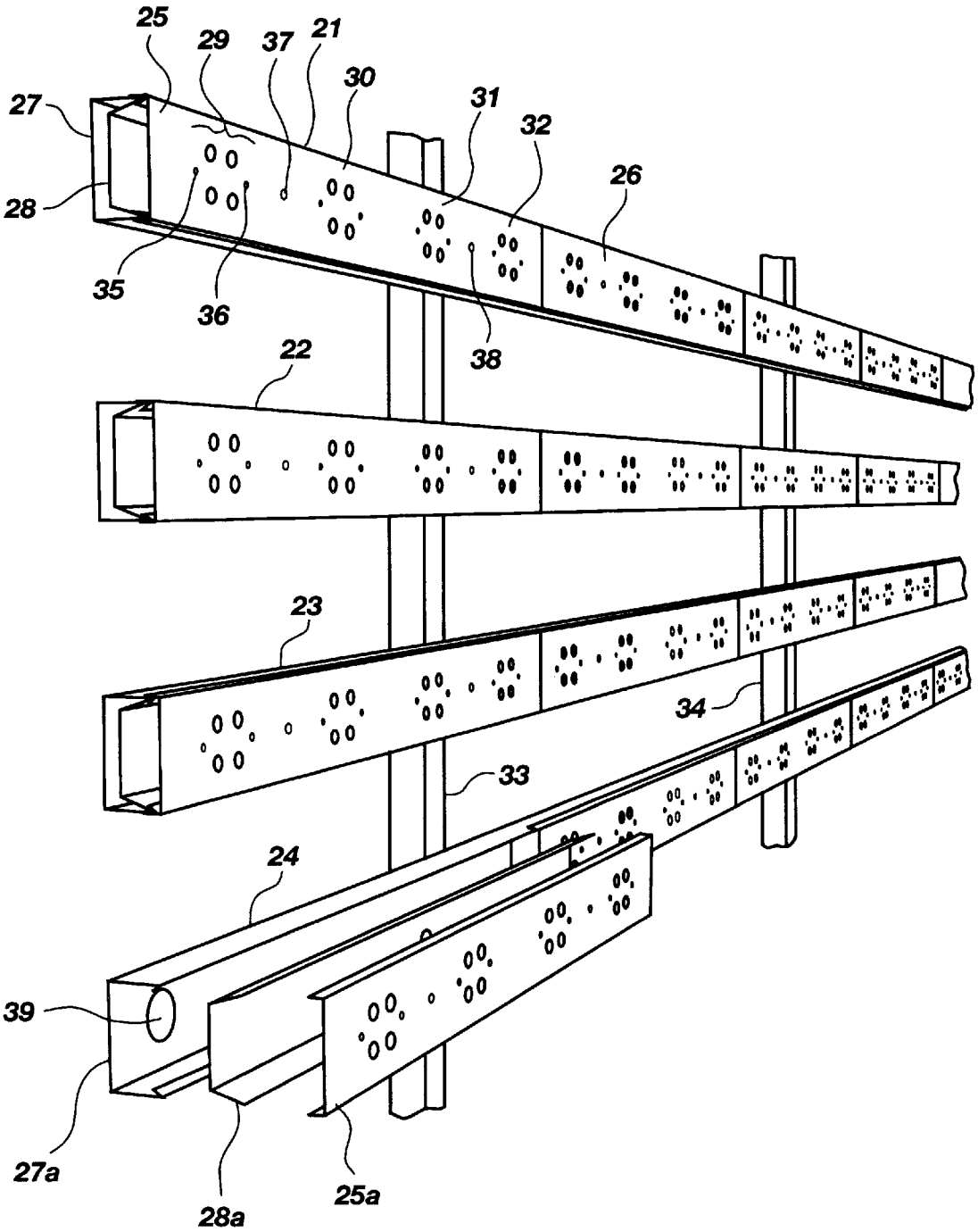
FIG. 4 is a perspective view of the portion of an individual lattice structure supporting parallel raceways.
Figure 5:
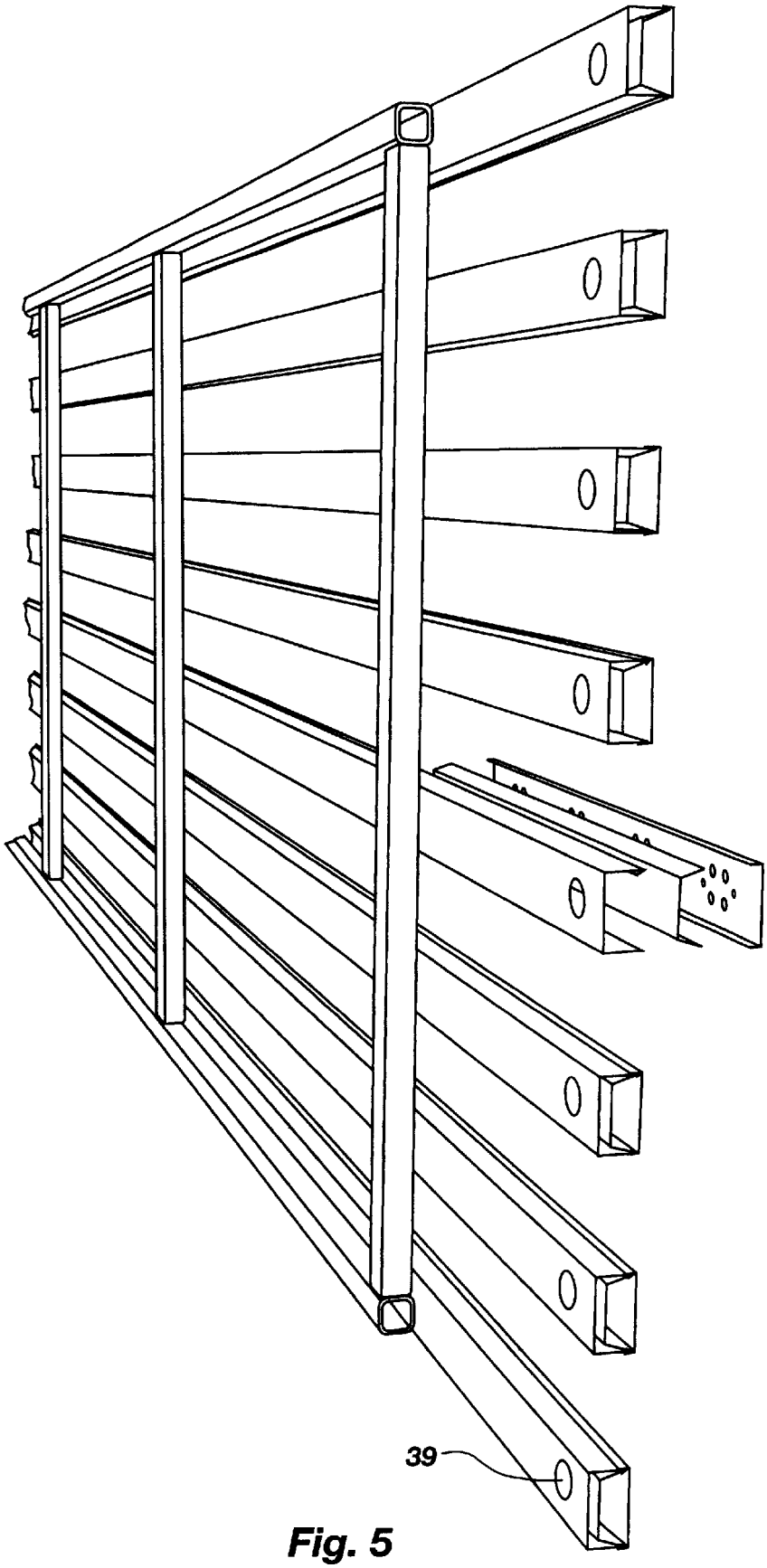
FIG. 5 is a perspective view of the reverse or backside of an individual lattice structure containing a plurality of linear raceways.

In FIG. 4 is a perspective view of the front or lamp bearing surface of a raceway. A group of raceways 21, 22, 23, and 24 are shown in spaced parallel relationship. A raceway is composed of three types of interacting channel members, a face channel member 25, a rear channel member 27 and an interior channel member 28. An extended raceway is composed of trios of interacting channel types such as channels 25, 27 and 28, joined endwise to similar interacting channels. Channel 25, having a length of two to three feet, is shown joined endwise to an adjacent channel 26. As illustrated in FIG. 4, a quartet of bulb holes 29 is positioned through the face surface of channel member 25. Channel member 25 contains four such quartets of bulb openings, that is, 29, 30, 31 and 32. The bulb openings are typically geometrically positioned at the corners of squares and as close together as practicable.

These bulb openings 29 etc. are spaced on centers which are in relation to the size of the lamp bulbs. The spacing is generally about one inch to about one and a half inch and preferably at a spacing, on-center, of about one and one quarter inch. The holes in the face of the raceway are approximately one inch in diameter. The spacing between one quartet of bulb openings to the next adjacent quartet is from about six to about ten inches on center and preferably at about eight inches on center. The center in this regard is the geometrical center of the four openings.

The width of channel member 25 is about three inches to about four inches and the spacing between channel member 25 and adjacent channel member 22 is from about three to about six inches. The spacing between adjacent raceways is such that the distance from one quartet of bulb openings on one raceway to the closest quartet of bulb openings on an adjacent raceway is approximately the same as the spacing between adjacent bulb opening quartets on the same raceway. That is, if the spacing on a particular raceway between adjacent quartets of bulb openings is about six inches on center, then the spacing between quartets of bulb openings on adjacent raceways of the most adjacent quartet is also about six inches. A preferred spacing between the quartets of bulb openings for the purposes of this invention is about eight inches. Thus, if a raceway is four inches wide, then the spacing between adjacent raceways is four inches to achieve center spacing of quartets of lamp openings in all directions of about eight inches. A preferred width for the raceway is about three and a half inches.

A quartet of bulb openings on one raceway is preferably aligned with a quartet of bulb openings on an adjacent raceway. A lattice structure of raceways has quartets of bulb openings aligned vertically and horizontally, i.e., along axes located at 90° to one another.

The raceway structures are preferably kept relatively narrow so that wind resistance and sun-blockage is minimized. For a structure as long as the arcade-like structure illustrated herein, minimal wind resistance is highly desirable. Also, it is desirable that the total canopy of the arcade-like structure be as light in weight as possible. It is, therefore, made with an open, frame-like structure, which has minimal structure to support the illumination display so that the supporting stanchions and support arms may also be smaller in dimension. The support arms and subarms are preferably sufficiently narrow that they do not greatly interfere with the viewing of the illuminated surface of the display.

Figure 7A:
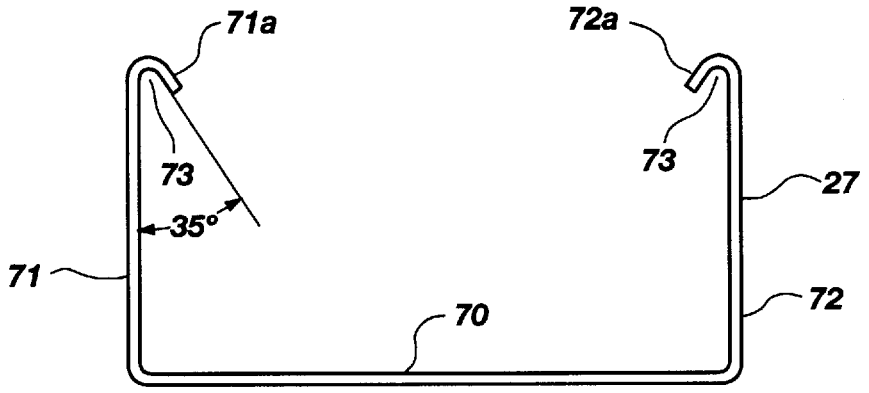
FIG. 7A is an end elevational view of one channel member of a raceway.
Figure 7B:
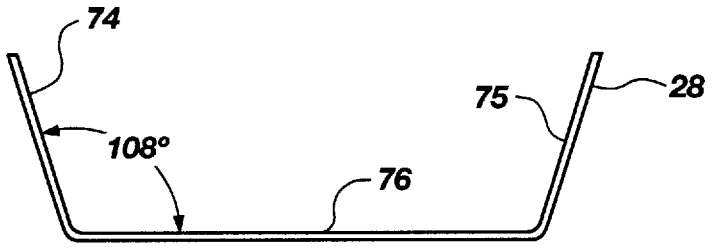
FIG. 7B is an end elevational view of an interior channel member of a raceway.
Figure 7C:
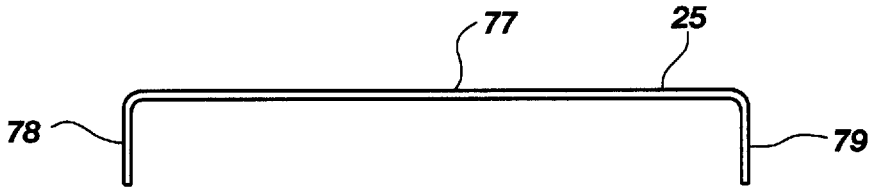
FIG. 7C is an end elevational view of another channel exterior member of said raceway.
Figure 7D:
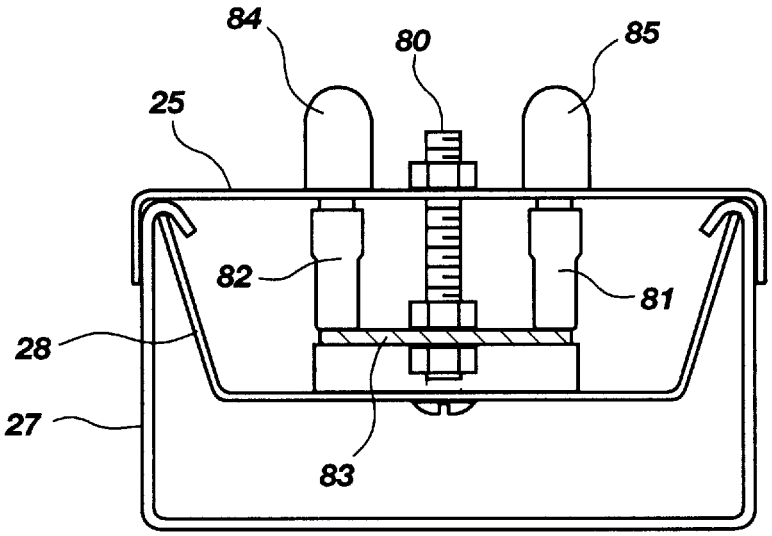
FIG. 7D is an end elevational view illustrating the three raceway channel members assembled to form a raceway and to illustrate the placement of bulb or lamp members in the raceway.

In FIG. 4, raceway 24 is shown in exploded view to illustrate the construction of channel member 27 which forms the back or rear portion of the raceway, channel member 25 which forms a face or front portion of the raceway and channel member 28 which serves as an internal divider and as a support member for the lamp fixtures as more clearly illustrated in FIG. 7D. The raceways 21, 22, 23, 24, etc. are fastened to two transverse lattice support members 33 and 34. The length of an individual channel member such as channel 25 is selected so that a maintenance person standing at one position may preferably reach all bulbs on a channel member 25. Preferably the spacing is such that if bulbs were burned out on raceways 21, 22, 23 and 24, then a maintenance person standing on an elevated platform of a lift or on a particular rung of the ladder could, without moving or being moved, reach many bulbs on such raceways, remove the closest face channels from these respective raceways and reach all of the bulbs or connectors behind the closest face channel of each of these raceways. That is, channel member 25 has a preferred length of about thirty to thirty-six inches so that all components behind channel member 25 may be reached by a person from one location without having to change ladder positions or change the position of a high lift platform from which a maintenance person might be operating.

Thus, for the purpose of the instant invention, the channel members 25, 27 and 28 have a preferred length of about thirty-two inches and form a raceway fragment. Numerous channel members, i.e. raceway fragments, are joined together endwise to form a complete raceway. In a preferred construction an individual lattice structure, such as illustrated in FIG. 4, is formed by eight raceways attached to five support frame members 33, 34, etc. A lattice structure having a total width of about five feet to about five and one-half feet and a total length of about twenty-four feet is constructed. A particular raceway having a length of twenty-four feet is constructed of nine face channels, each having a length of about two feet eight inches. Also nine interior channels and nine rear channels would also be used for each raceway of twenty-four feet in length. Thus, an individual lattice structure of more than five feet in width and twenty-four feet in length is sufficiently light in weight that it can be readily installed on the interior surface of the arcade.

Referring to FIG. 2, approximately seventeen lattice structures of five feet in width form an arc illustrated by the 125° interior angle. Seventeen lattice structures of a width of approximately five feet four inches gives a total arc distance of about ninety feet eight inches, assuming that the individual lattice structures are spaced at about five inches between the next adjacent lattice structure which then would give the same spacing between adjacent quartets of bulb openings on adjacent lattice structures as on adjacent raceways. A distance of five inches between adjacent lattice structures of sixteen spaces gives an additional six feet eight inches in one instance of the invention. As illustrated in FIG. 2, a total arc length of from one side to the other of the display surface would be about ninety-seven feet four inches. This is by way of example and individual lattice structures could be constructed with fewer raceways or with raceways which were more narrow and which included more raceways or lattice structures which were smaller in width or greater in length. However, considerations of pre-assembly of lattice structures to make them accurate and considerations of lifting individual lattice structures into position and considerations of maintenance determine the construction of a particular lattice size. Thus, in the instance given, the particular lattice structure is five feet four inches in width and represents the chord of an arc which a particular lattice structure embraces. Thus, as previously stated, the interior surface of the illuminated display is not a pure curve, but is a series of joined straight segments which, because of the short nature of the segments and the long radius of the arcade-like structure, closely approximates a curved surface which preferably is an arc of a circle.

Further illustrated in FIG. 4, a pair of bolt openings or screw openings 35 and 36 are closely positioned along each quartet of bulb openings. Screw openings accept screws which hold plastic domes or lenses which cover the quartet of bulbs which project through the bulb openings 29. Further bolt openings 37 and 38 exist for each face channel member, for example, face channel 25. These bolt openings accept bolts which hold the face channel to the interior channel and to the rear channel members. Thus, by removing two bolts which fit within bolt openings 37 and 38, channel member 25 may be removed from a raceway. As illustrated in FIGS. 4 and 5 an opening 39 exits in the rear of the rear channel member, for example, channel member 27 or 27A. This opening is to accept the conduit and wiring which goes into the raceway to connect all the bulbs in a particular raceway. A grommet or seal may be used to seal opening 39 and the electrical wiring or conduit which passes therethrough.

Figure 6A:
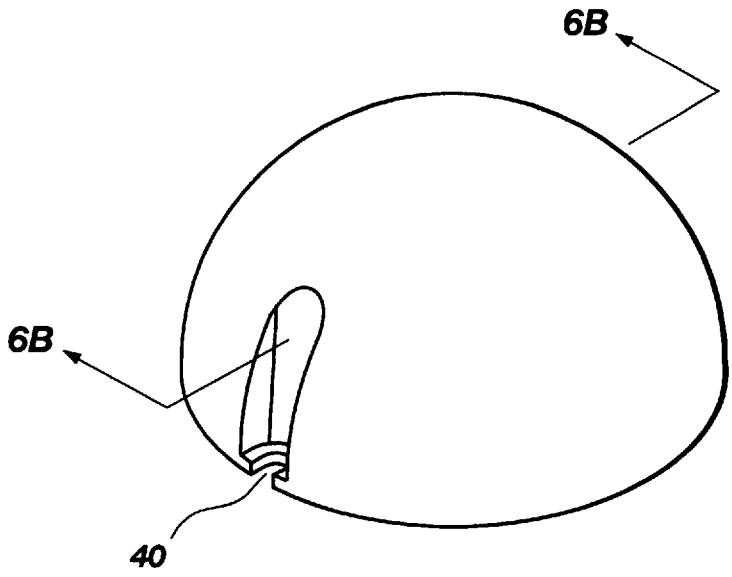
FIG. 6A is a perspective view of a translucent diffusion dome for placement over a pixel.
Figure 6B:
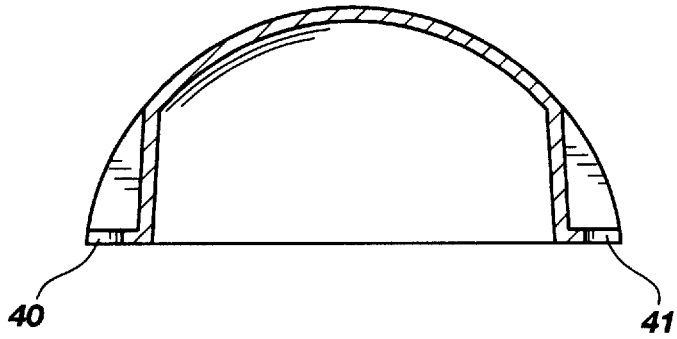
FIG. 6B is a sectional view of the diffusion dome of FIG. 6A along section lines 6B—6B of FIG. 6A.

The domes or lenses utilized to cover a quartet of lamps to form a pixel are illustrated in FIGS. 6A and 6B. The dome or lens is preferably a substantially hemispherical surface of translucent material so that the light coming through the lens is diffused. Other geometrical shapes may be utilized to cover a quartet of bulbs to form a pixel. Thus, the light from all of the bulbs is blended so that the lens presents a particular color or hue of color at a given intensity. Thus, if only the red bulb is lit then the lens will have a red color. If only the white bulb is lit, the lens will have a white color. If different combinations of the red, green and blue lamps are lit, then different colors will be exhibited by a lens although it will appear to have a single color at any one instance. By controlling the intensity of each bulb a myriad of colors, hues, and tones may be obtained. With four bulbs wherein each bulb has an intensity control at about 16 different levels from being very dim, or out, to full intensity, an array of colors and hues for each pixel of over 65,000 different colors and hues may be obtained.

The lens as illustrated in FIG. 6A and 6B can be attached by screws to a face channel member. The lens has sufficient diameter and height that it has sufficient interior space to accommodate all four bulbs of a particular quartet of bulbs. Screw slots 40 and 41 at the base of the lens are provided so that the lens may be readily attached to the face channel of a raceway.

For an arcade of the type design described herein with individual lattice members approximately five feet four inches by twenty-four feet and for an arcade of approximately 1,350 feet in length with 17 individual lattice members forming an arch segment, a total of close to 1,910,656 bulbs would be present which would require approximately 477,664 lamp covers. A total square footage of illumination for a 1,350 foot arcade with seventeen individual lattice members across the arch would be well in excess of about 100,000 square feet of apparent illuminated surface.

The structure of an exemplary raceway is illustrated in FIGS. 7A, 7B, 7C and 7D. FIG. 7A is the back channel member 27 of a raceway section. It has a rear panel or web 70 and side panels 71 and 72. The forward edges of the side panels are folded to form a gutter 73 and 74. Folded edges 71A and 72A are sufficiently long that to overlap the flared side panels 74 and 75 of interior channel member 28 as illustrated in FIG. 7B and the overlapping shown in FIG. 7D. The folded edges of 71A and 72A are folded to have an included angle of about 35°. This could vary from a more narrow to a wider angle. The length of the lip 71A may vary, although typically it is about one-quarter inch. The flared side panels of interior channel 28 have included angles of about 100°. Again, this may vary somewhat, but it should be sufficiently greater than FIG. 9A.

The width of side panel 71 of rear channel 27 has a width preferably of an inch or more and typically is about 1¾ inches. The height of side member 74 of interior channel 28 is generally less than about an inch. Thus, as illustrated in FIG. 7D, an open area of about ¾ inches exists between channel member 27 and channel member 28 to accommodate wiring conduit and the like. Channel 25, see FIG. 7C, is the face channel and has a face surface 77 and side surfaces 78 and 79. The side panels of channel 25 are generally about one-half inch in width. The width across the face of channel 25 is slightly greater than 3½ inches and it has about a 3½ inch inside dimension.

The assembly of the three channel members to form the raceway is illustrated in FIG. 7D. Channel 25 covers channel 27 while channel member 28 has its side panels fitting up into the slots or grooves formed by the folded back lips of channel member 27. A bolt member 80 holds channel 28 and channel 25 together. The lamp assembly socket is illustrated wherein four socket members, such as socket members 81, 82 (two socket members not shown) would be attached to a lamp assembly 83. Bulbs 84 and 85 project through the bulb openings in the face of channel member 25.

The raceways are generally formed into a lattice member which are mounted on the arcade-like structure illustrated herein so that the bulbs are generally facing in a generally downward position. Those at the top of the arch face directly down while those at the sides of the arch are slanted in a downward direction. Thus, rain, snow and the like generally hit the back of the raceway. That is, channel 27 generally has only one opening per raceway and that may be readily sealed by a rubber grommet or the like to prevent water from getting into the interior of the raceway. Generally, it is preferred to have a rubber gasket fit along the folded edge between channels 25 and 27 so that those raceways which face in a downward direction may not have water running off the back of channel 27 the side and into the interior of the raceway. Since the raceway is oriented so that the bulbs point at least in a slanted downward direction even on a raceway near the lower edge of the arch, there is not much likelihood of water coming in through the bulb openings. A weep hole may be provided in a side surface of the raceway so that any water that collects inside may drain out. The weep hole would be oriented in a generally downward direction so that no rain, water, snow or the like could enter into the raceway through the weep hole.

The individual light bulbs are all computer controlled and a significantly large number of computers may be utilized to control the whole lighting arrangement. Upwards of five, ten or more computers may be utilized to control the system with a master controller computer controlling each individual computer.

Figure 8:
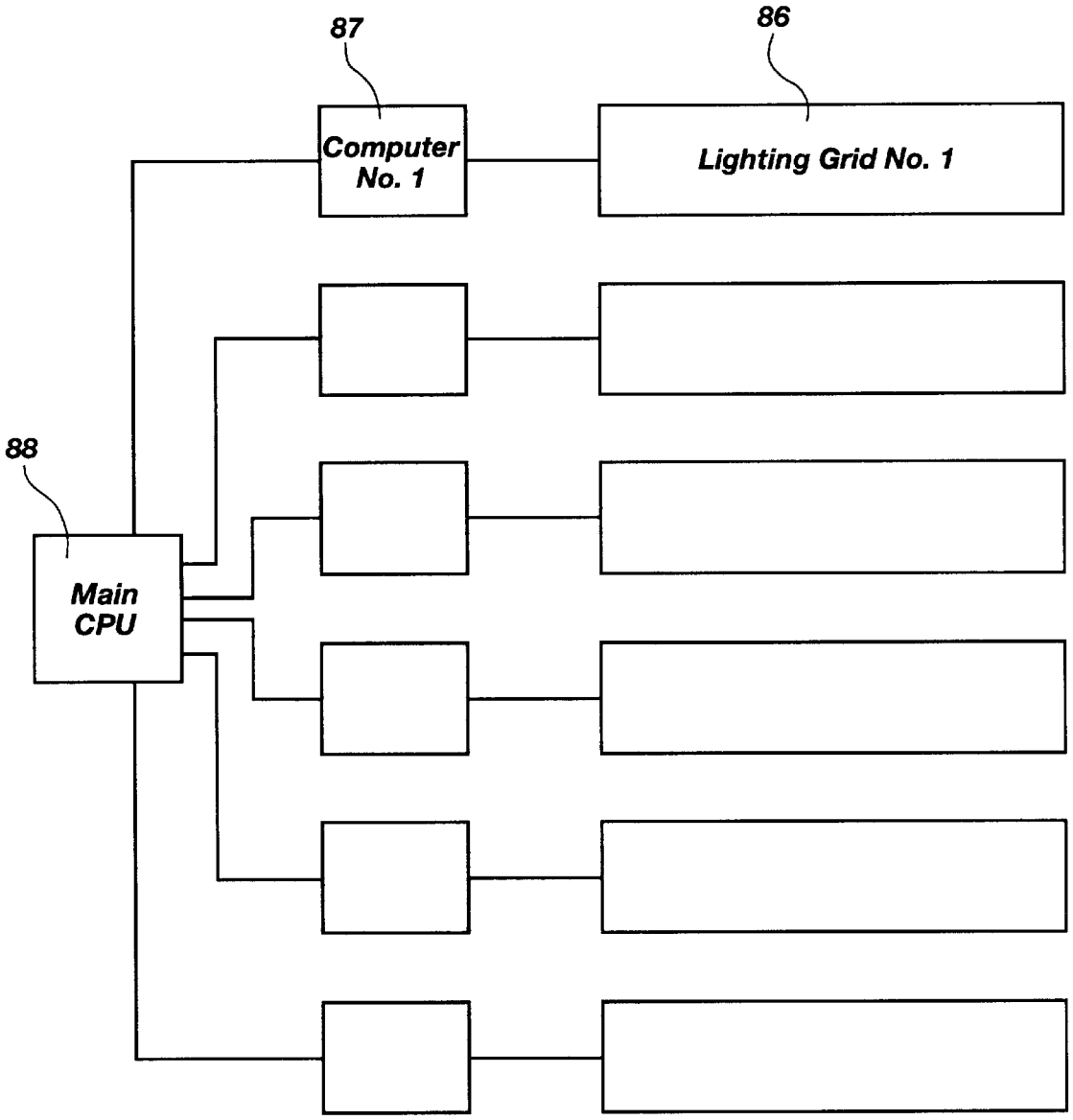
FIG. 8 is a schematic illustration of the overall control system for a lighting display.

A schematic illustration of the control system of the invention is presented in FIG. 8. The complete display is composed of a number of lighting grids (banks) 86, each of which is controlled by a slave computer 87. Each slave computer is controlled by a main central processing unit 88.

Each slave computer may be preprogrammed with one or more display performances for its particular grid. The main computer likewise may be preprogrammed to control each of the slave computers for a particular performance. The main computer may also be preprogrammed for one or more lighting performances. The main computer controls each slave computer as to which performance is to be conducted and to coordinate the sequencing of each individual slave computer.

Each lighting grid (bank) may contain many individual lattice structures of the type described in reference to FIG. 4. Thus, a particular lighting grid may contain in excess of 100,000 bulbs (lamps) or even 200,000 or more. A total display having one million or more lamps may utilize five to ten lighting grids with each grid controlled by its own slave computer.

Although a complete display may be composed of various arrangements of lighting grids, it is generally preferred that the grids be segments arranged in a pure or modified linear arrangement. In the arcade structure illustrated in FIG. 3, it is preferable that each grid be a preselected portion of the length of the arcade. Thus, a particular grid would include the complete arch of the arcade for a preselected linear distance. Slave computer stations could then be located at or near the base of a particular support stanchion. In a modified linear arrangement of individual lighting grids, each grid may be one-half of the arch for a preselected linear distance.

Generally, it is preferred that each slave computer controls the same number lamp groups, pixels, as each other slave computer. Segmenting the arcade or total display structure linearly permits different performances to be conducted on one-half of the total structure while another performance is conducted on the other one-half or the grids on the ends may be shut down and a performance conducted on the central grids.

Although the illuminated display of the instant invention has been described in reference to an arcade-like structure, the invention has applicability to any illuminated display of an especially large nature. It is particularly well suited to large outdoor displays, especially displays in regions where high wind or snow loads may be encountered. The systems of the instant invention facilitate the construction and maintenance of any large overhead display, whether it is oriented substantially vertically or substantially horizontally.

Besides the arcade-like structure of the type illustrated herein, a large, overhead display incorporating the systems of the instant invention could be constructed as a trellis-like structure with a large, substantially horizontal overhead display in a lattice-like configuration.

Although large overhead displays, generally in a substantially vertical orientation, such as ballpark scoreboards, are currently made with a planar substantially continuous surface, behind which the wiring, switches, etc. may be concealed, the systems of the instant invention are also well suited for construction, operation and maintenance of such very large, substantially-vertical displays supported by tall steel columns or standards. Because the display systems of the instant invention have less wind resistance, very large displays positioned at considerable heights can be safely constructed. Because the spacing between adjacent raceways is about the same as the width of the raceway, displays having the appearance of about twice the area of currently existing scoreboard-type displays could be readily constructed, operated and maintained.

Large, indoor displays may also be readily constructed using the systems described herein. In structures such as the King Dome, the Superdome, and similar structures, the inside of the dome, or other shaped ceiling, could be fitted with the lattice-like structures of the instant invention to provide an overhead display. Such domed or hemispherical displays could be readily utilized to give unique light shows and could be programmed to give planetarium-type shows as well as informational and other displays.

What is claimed is:

1. An outdoor, electrical-lamp display structure comprising:

an elongated, elevated open-frame support structure;

linear raceway members attached closely adjacent to each other in substantially parallel relationship on said frame structure to run substantially the length of said structure, said raceway members having a box-like cross section and being structured and adapted to house internally electrical wiring and having a plurality of groups of closely spaced bulb openings on the same surface of a raceway, said openings structured and adapted to hold electrical lamps.

2. The display structure of claim 1, wherein said linear raceway members comprise raceway segments joined end-to-end.

3. The display structure of claim 1, wherein said group of closely spaced openings comprise at least three openings.

4. The display structure of claim 3, wherein said group of closely spaced openings consists essentially of four openings.

5. The display structure of claim 1, wherein the groups of closely spaced openings are regularly spaced along the surface of said raceway.

6. The display structure of claim 5, wherein the groups of closely spaced openings are spaced from about four to twelve inches from one another.

7. The display structure of claim 1, wherein said raceway members are regularly spaced from one another.

8. The display structure of claim 1, wherein the spacing between adjacent raceways is such that the spacing between an adjacent pair of groups of bulb openings on one raceway is substantially the same as the spacing between an adjacent pair of groups of bulb openings in a pair of raceways adjacent to one another.

9. The display structure of claim 8, wherein the spacing between adjacent raceways is from about two to twelve inches.

* * * * *